US007775468B2

(12) United States Patent
Bednarski et al.

(10) Patent No.: US 7,775,468 B2
(45) Date of Patent: Aug. 17, 2010

(54) HAMMERMILL WITH ROTATABLE HOUSING

(75) Inventors: Joseph John Bednarski, Minneapolis, MN (US); David A. Hauch, Afton, MN (US)

(73) Assignee: Carter Day International, Inc., Fridley, MN (US)

( * ) Notice: Subject to any disclaimer, the term of this patent is extended or adjusted under 35 U.S.C. 154(b) by 614 days.

(21) Appl. No.: 11/746,255

(22) Filed: May 9, 2007

(65) Prior Publication Data

US 2008/0277515 A1 Nov. 13, 2008

(51) Int. Cl.
*B02C 13/00* (2006.01)
*B02C 18/30* (2006.01)

(52) U.S. Cl. ..... 241/188.1; 241/285.2

(58) Field of Classification Search ..... 241/188.1, 241/189.1, 186.2, 285.2
See application file for complete search history.

(56) References Cited

U.S. PATENT DOCUMENTS

| | | | | |
|---|---|---|---|---|
| 1,185,620 | A | | 6/1916 | Blum |
| 2,087,492 | A | | 7/1937 | Williams |
| 2,171,296 | A | * | 8/1939 | Voungman et al. ..... 241/38 |
| 2,640,650 | A | | 6/1953 | Jacobson |
| 2,785,865 | A | | 3/1957 | Berling |
| 2,803,634 | A | | 8/1957 | Chayen |
| 2,922,589 | A | | 1/1960 | Sheldon |
| 3,143,303 | A | | 8/1964 | Palyi |
| 3,170,640 | A | | 2/1965 | Kolts et al. |
| 3,279,707 | A | | 10/1966 | Jacobson |
| 3,329,350 | A | * | 7/1967 | Wisgerhof et al. ..... 241/38 |
| 3,501,100 | A | * | 3/1970 | Schellberg ..... 241/91 |
| 3,554,454 | A | | 1/1971 | Gruendler |
| 3,593,930 | A | * | 7/1971 | Lautzenheiser ..... 241/188.1 |
| 3,823,878 | A | | 7/1974 | Ishikura |
| 3,825,194 | A | | 7/1974 | Buell |
| 3,834,632 | A | * | 9/1974 | Docksteader ..... 241/187 |
| 3,966,126 | A | * | 6/1976 | Werner ..... 241/19 |
| 4,129,262 | A | | 12/1978 | Lowry |
| 4,243,182 | A | | 1/1981 | Dugger, Jr. |
| 4,650,127 | A | | 3/1987 | Radwanski et al. |
| 4,702,426 | A | * | 10/1987 | Citterio ..... 241/167 |
| 4,875,630 | A | | 10/1989 | Carlson |
| 5,110,059 | A | * | 5/1992 | Titmas et al. ..... 241/47 |
| 5,205,498 | A | * | 4/1993 | Ostermeier et al. ..... 241/55 |
| 5,421,528 | A | | 6/1995 | Ronning |
| 5,794,865 | A | | 8/1998 | Didion et al. |
| 6,637,682 | B2 | | 10/2003 | Akiyama et al. |
| 6,926,215 | B2 | | 8/2005 | Elliott |
| 7,004,412 | B2 | | 2/2006 | Olson |
| 2001/0045478 | A1 | | 11/2001 | Recker et al. |

FOREIGN PATENT DOCUMENTS

| | | | |
|---|---|---|---|
| EP | 0486856 | A1 | 10/1991 |

* cited by examiner

*Primary Examiner*—Faye Francis
(74) *Attorney, Agent, or Firm*—Fredrikson & Byron, P.A.

(57) ABSTRACT

The invention includes a hammermill for comminuting material. The hammer includes a housing and a cutting plate disposed within the housing. A rotor assembly is rotatably mounted within the housing about an axis of rotation and a plurality of hammers are functionally coupled to the rotor assembly. The housing is rotatable about the axis of rotation.

25 Claims, 12 Drawing Sheets

HAMMERMILL WITH ROTATABLE HOUSING

FIELD OF THE INVENTION

The invention generally relates to hammermills.

BACKGROUND OF THE INVENTION

Hammermills are used for grinding or comminution of materials. Typically hammermills consist of a rotor assembly mounted on a driven rotor shaft inside a fixed housing that defines a working chamber. The fixed housing is fixedly connected to a base that also supports a motor for driving the rotor shaft. As the driven rotor shaft rotates it causes rows of hammers to impact and reduce the material within the working chamber. Cutting plates are mounted within the working chamber to promote reduction of the material.

Generally, the hammers and cutting plates wear during use. In a typical hammermill, the fixed housing must be removed to gain access to the hammers and cutting plates. The housing is typically heavy and is not easily removed. Further, the working chambers and rotor assemblies of such hammermills are not easily removable from the hammermill base.

SUMMARY OF THE INVENTION

In some embodiments, the invention includes a hammermill for comminuting material, such as agricultural products (e.g., corn). The hammermill includes a housing and a cutting plate disposed within the housing. A rotor assembly is rotatably mounted within the housing about an axis of rotation and a plurality of hammers are functionally coupled to the rotor assembly. The housing is rotatable about the axis of rotation. In some embodiments, the housing includes a generally cylindrical body, a first end plate, and a second end plate, which together define a working chamber of the hammermill. The generally cylindrical body can include two or more sections. Each section can be removed from the end plates to provide access to the interior of the hammermill.

Such a rotatable housing provides several advantages. For example, such a rotatable housing allows for easy access to the interior of the housing. After a housing body section is removed, the housing can be rotated to orientate another section to a position where it can be easily accessed and removed. Such a feature promotes easy access to the interior of the hammermill for maintenance, such as replacing hammers and cutting plates.

In some embodiments, the housing is disposed on a base and supported by bushing blocks. In certain embodiments, the rotatable housing and rotor assembly can be easily removed from the base and placed on another base. Such embodiments are useful for quickly replacing the working chamber and/or rotor assemblies of the hammermill. Embodiments of the invention also include methods of using and making such a hammermill.

DETAILED DESCRIPTION OF THE INVENTION

Figure 1:
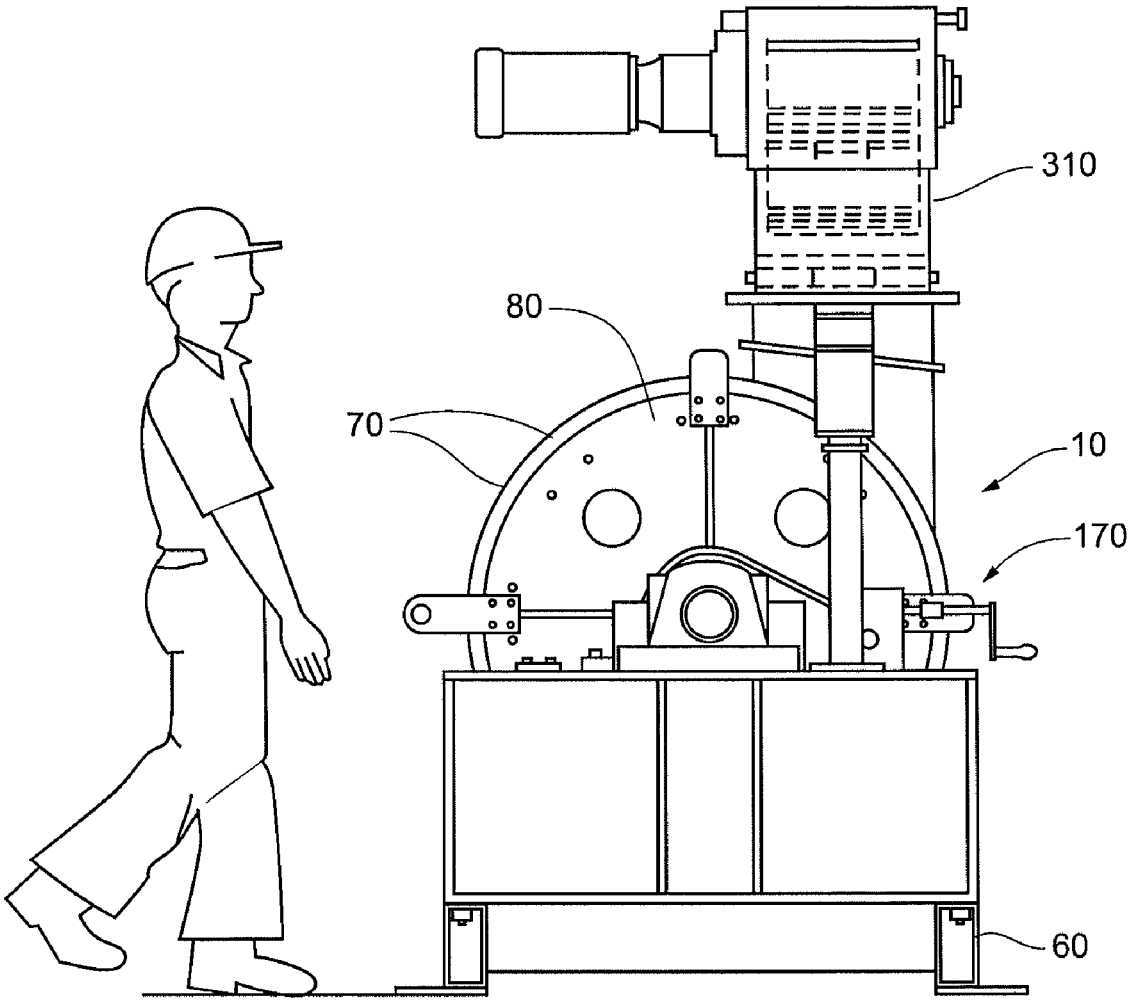
FIG. 1 shows a side plan view of a hammermill in accordance with an embodiment of the invention.

For the purpose of promoting an understanding of the principles of the invention, reference will now be made to the embodiments illustrated in the drawing and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates.

Figure 2:
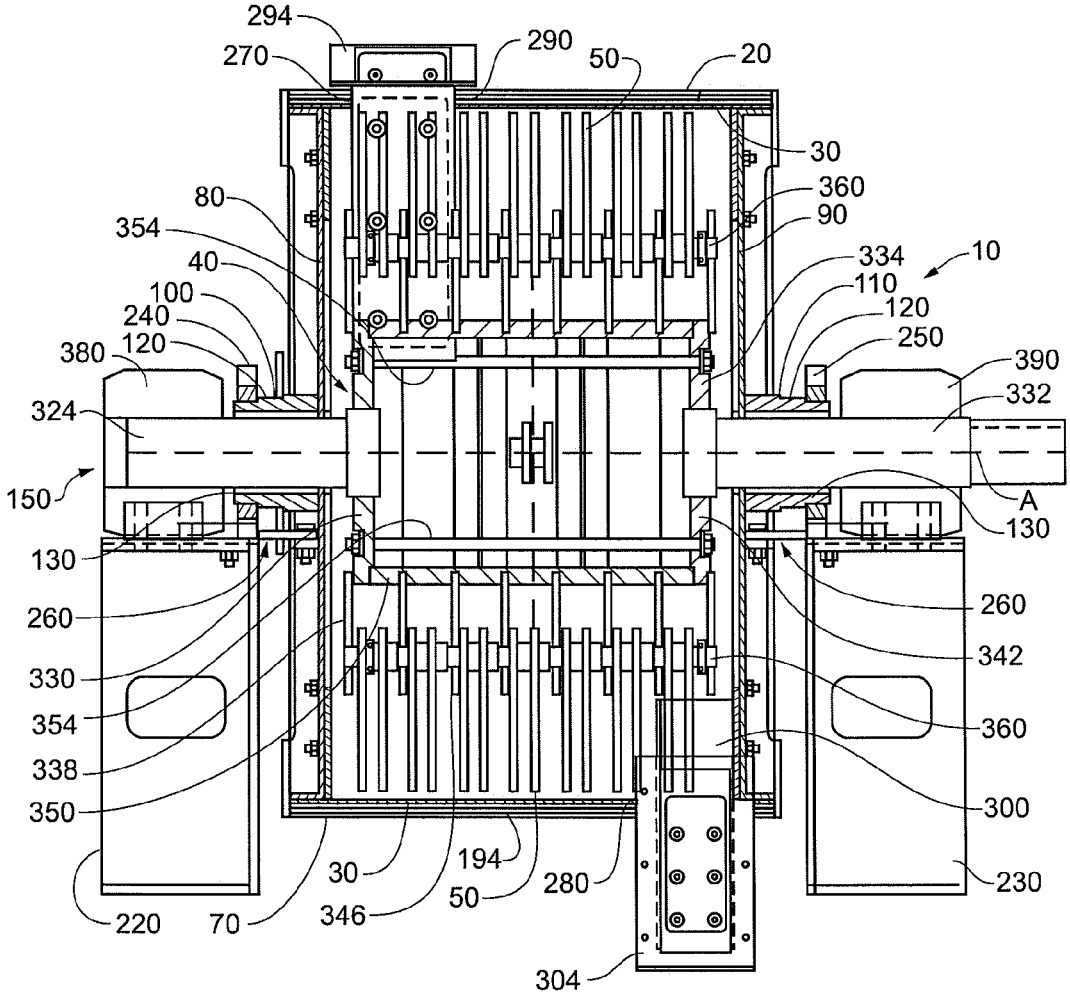
FIG. 2 shows a front cross-section view of a hammermill in accordance with an embodiment of the invention.
Figure 3:
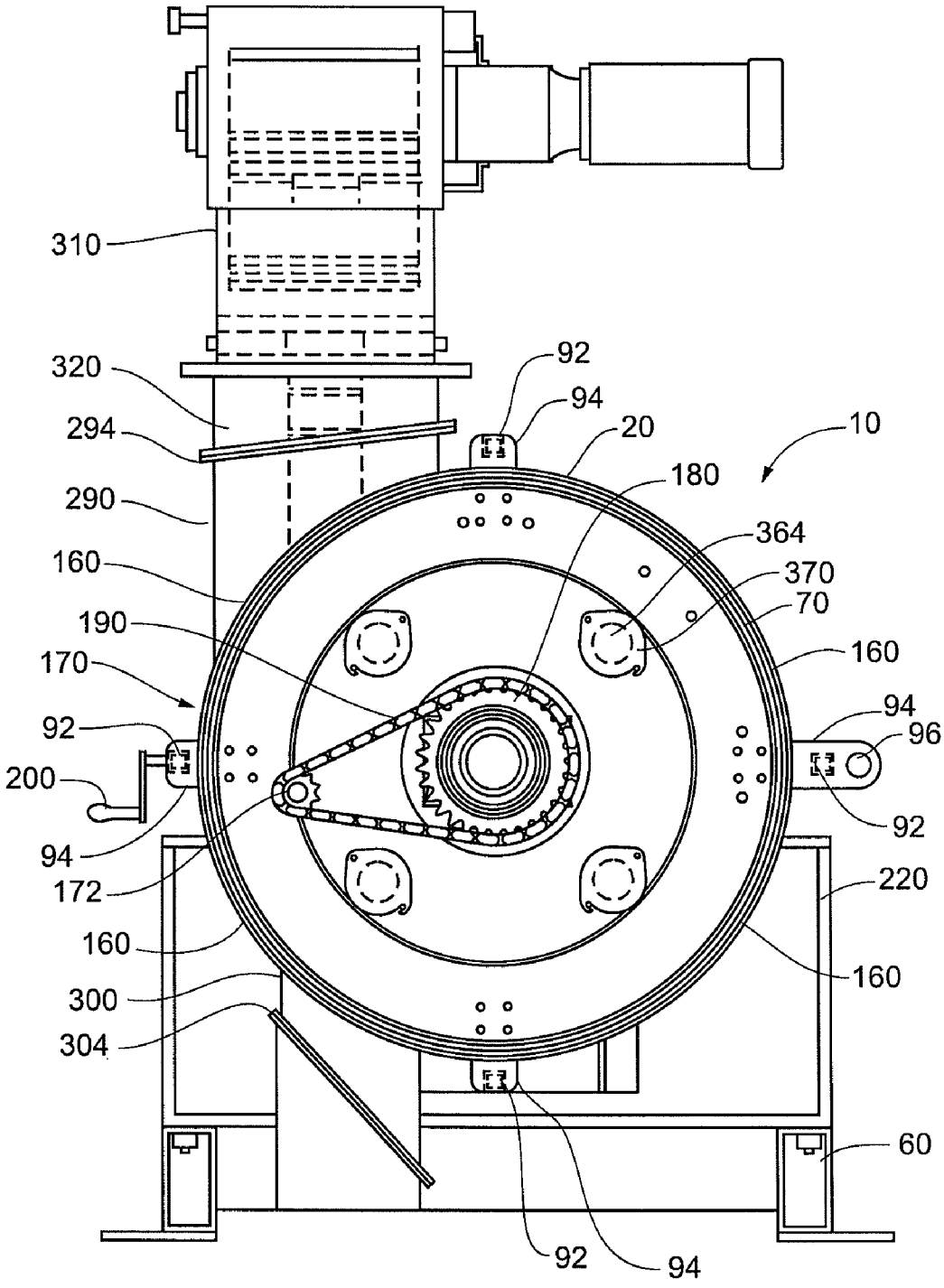
FIG. 3 shows a side plan view of a hammermill with a rotatable housing in a first position in accordance with an embodiment of the invention.
Figure 4:
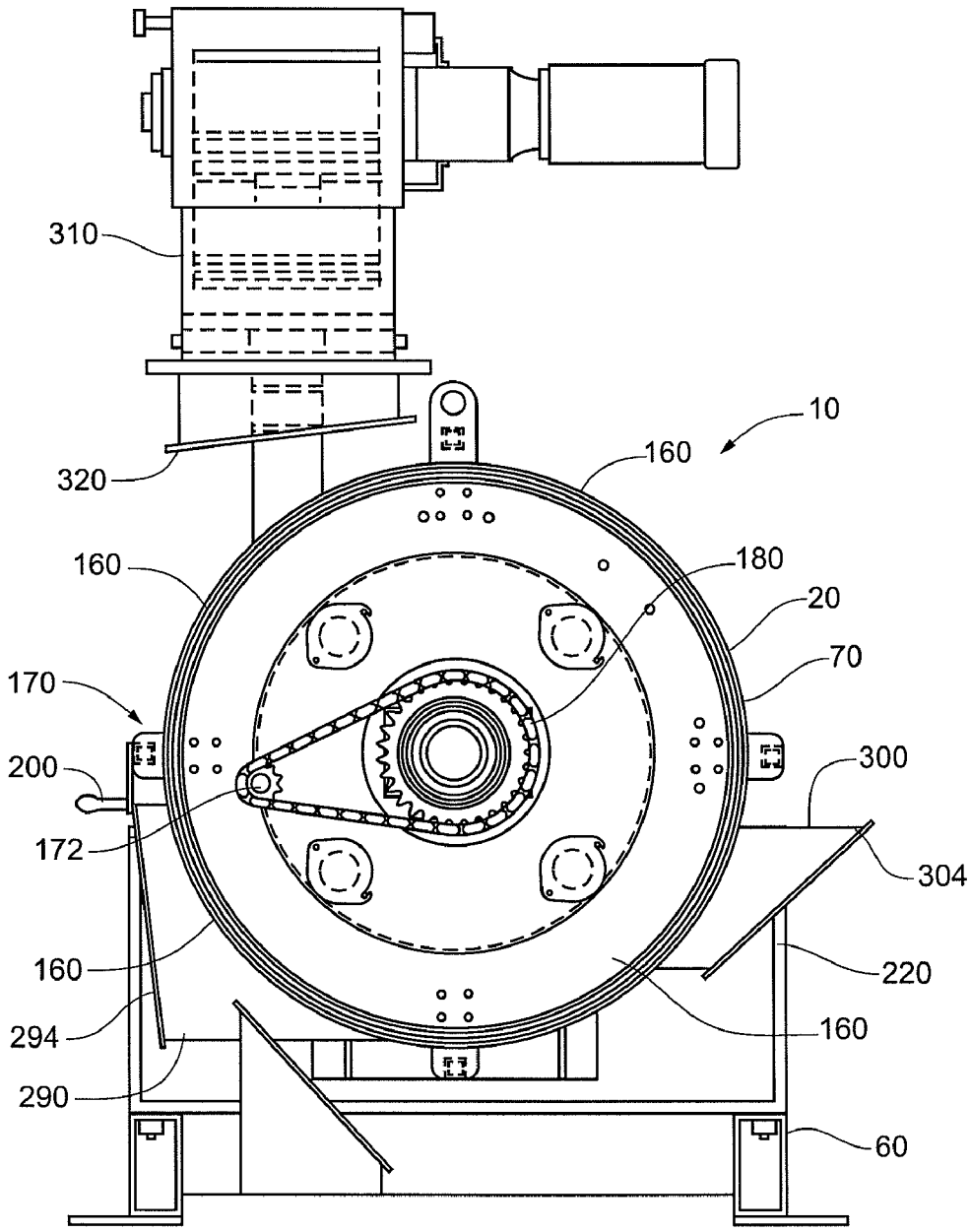
FIG. 4 shows a side plan view of the hammermill of FIG. 3 with the rotatable housing in a second position in accordance with an embodiment of the invention.
Figure 5:
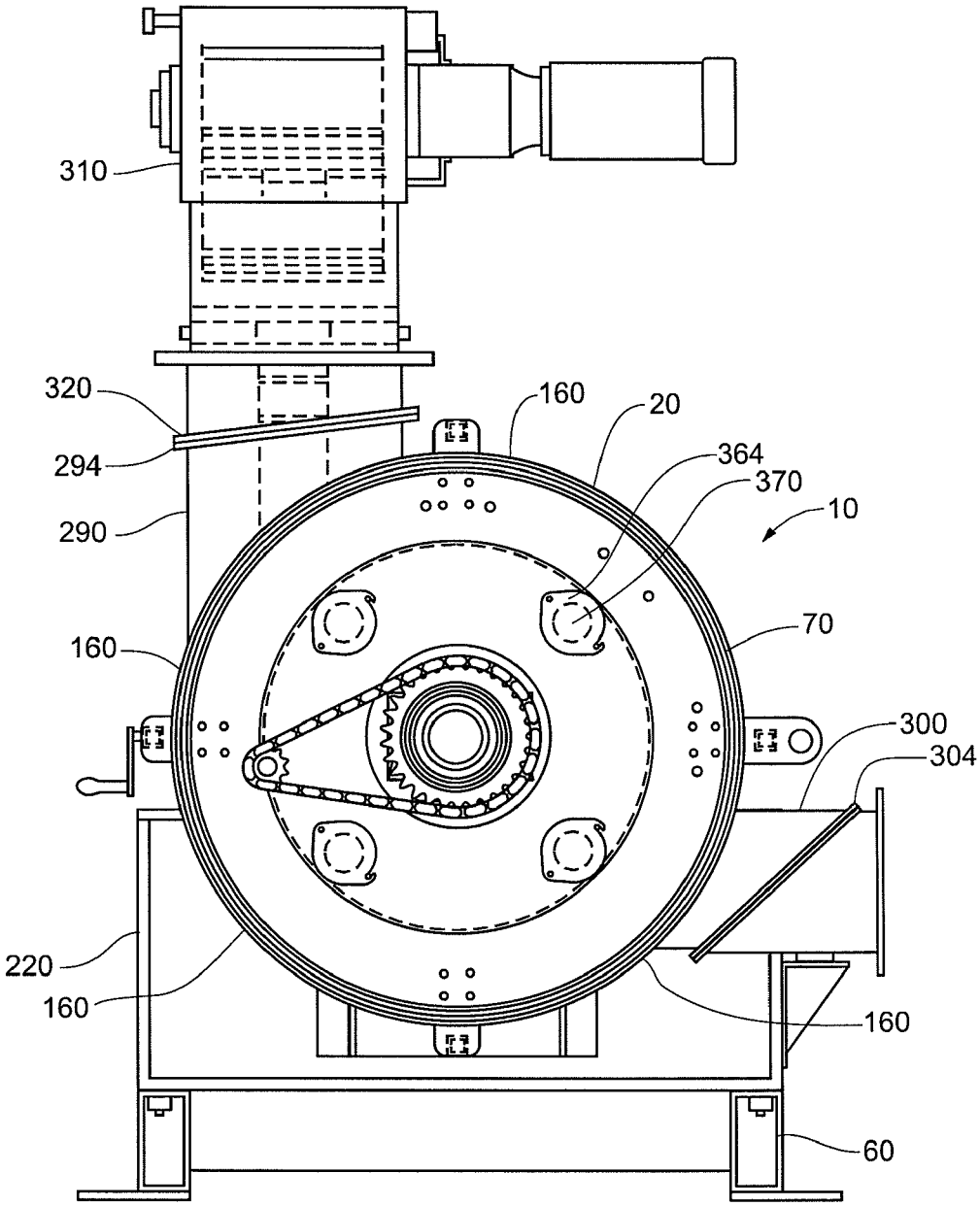
FIG. 5 shows a side plan view of a hammermill with a rotatable housing in a first position in accordance with another embodiment of the invention.
Figure 6:
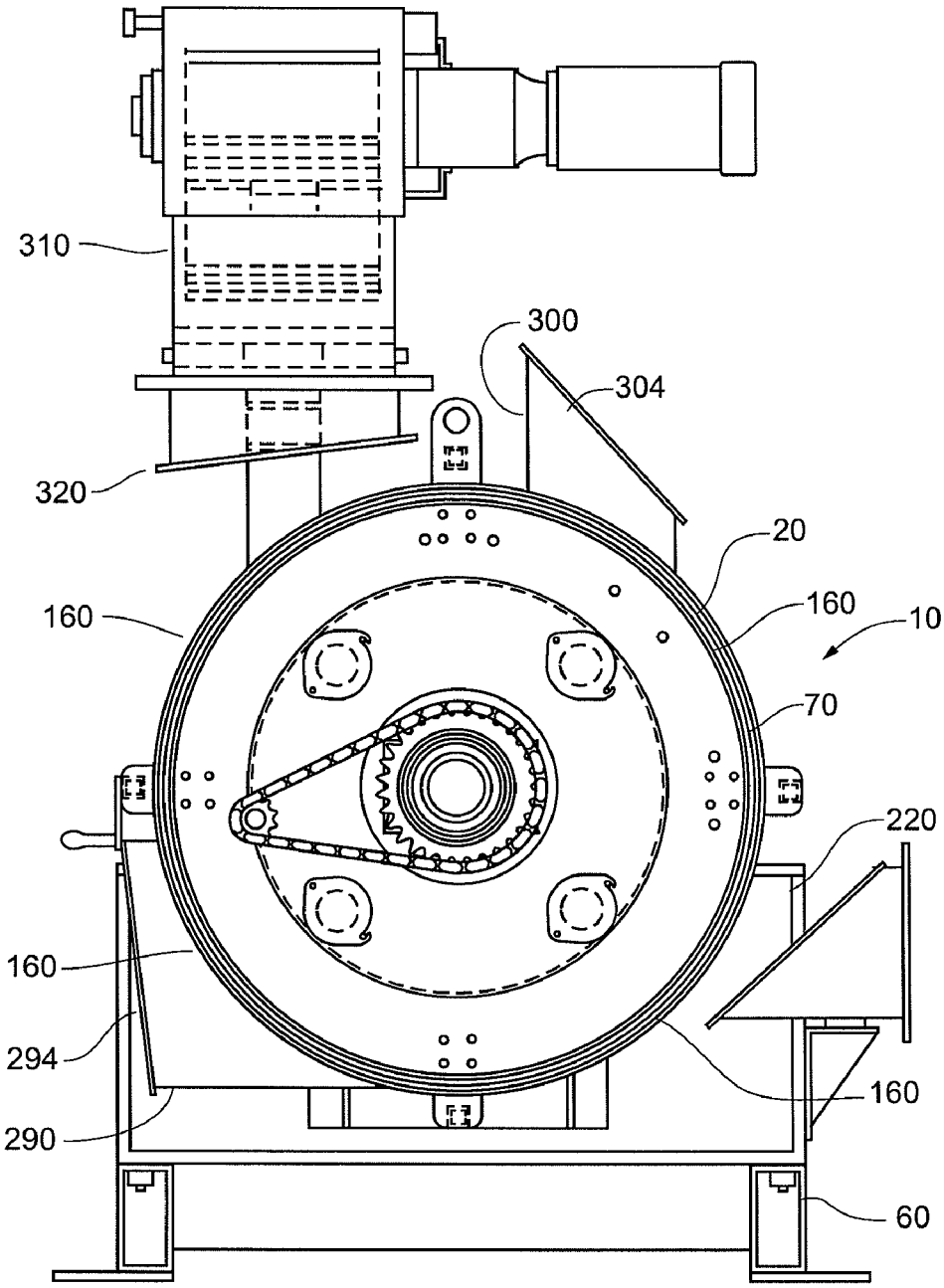
FIG. 6 shows a side plan view of the hammermill of FIG. 5 with the rotatable housing in a second position in accordance with an embodiment of the invention.

As shown in FIG. 1, embodiments of the invention include a hammermill 10 for comminuting material. The hammermill 10 includes a housing 20 and a cutting plate 30 and a rotor assembly 40 disposed therein, as shown in FIG. 2. A plurality of hammers 50 can be functionally coupled to the rotor assembly 40. The housing 20 can be rotatable about an axis of rotation. In some embodiments, the hammermill 10 includes a base 60 that supports the housing 20. FIGS. 3-6 show two alternative embodiments in first and second rotational positions. FIG. 3 shows a first embodiment of the hammermill 10 in a first rotational position, and FIG. 4 shows the hammermill of FIG. 3 in a second rotational position, where the housing body 70 has been rotated counterclockwise about 90 degrees. Such embodiments allow for sufficient rotation to allow for convenient access for hammermill maintenance. FIG. 5 shows a second embodiment of the hammermill 10 in a first rotational position, and FIG. 6 shows the hammermill of FIG. 5 in a second rotational position, where the housing body 70 has been rotated counterclockwise about 90 degrees.

In some embodiments, the housing 20 includes a housing body 70, a first end plate 80, and a second end plate 90. The housing body 70 can have a generally cylindrical shape and can be coupled to the first and second end plates by any suitable means, such as bolting. In certain embodiments, as shown in FIG. 3, at least one (e.g., four) cross-bars 92 are provided to provide structural rigidity to the housing. As shown, cross-bars 92 can be provided external to the housing body and generally parallel with the axis of rotation. Such cross-bars can be provided about every 90 degrees along the circumference of the end plates and can attach to corresponding flanges 94 extending from each end plate. In some embodiments, one or more of the flange pairs 94 is provided with a lifting lug 96 to allow the housing to easily be attached to a lift or hoisting mechanism to lift the housing from its base. Locating the lifting lug proximate to a cross-bar provides structural support to the housing while it is lifted by the lifting lug.

In some embodiments, first end plate 80 includes a first end plate shaft 100 and second end plate 90 includes a second end plate shaft 110. These shafts define a longitudinal axis that coincides with an axis of rotation of the rotor assembly 40. The first and second end plate shafts can be connected to the first and second end plates, respectively, by any suitable method. For example, the shafts can be welded to, bolted to, and/or integrally formed with their respective end plates.

The rotor assembly 40 and housing 20 can each rotate about a common axis of rotation, A, as shown in FIG. 2. In some embodiments, the first and second end plate shafts 100, 110 each have an outer cylindrical surface 120 and an inner cylindrical surface 130, the inner cylindrical surface 130 defining a cavity 140 to receive a rotor shaft 150 of the rotor assembly 40.

The housing body 70 can be provided in two or more sections 160, as shown in FIGS. 3-6. Each section 160 can be independently removable from the end plates. Such sections 160 are useful for providing access to the interior 164 of the hammermill 10, as shown best in FIG. 7. For example, a section 160 of the housing body 70 can be removed, and the housing 20 can be rotated to position another section 160 so it is easily accessible for removal. The sections 160 can be rotationally positioned and removed in this manner until the interior of the hammermill 10 is adequately exposed for maintenance. In some embodiments, the housing body 70 comprises two or more sections 160, and, in some embodiments, the housing body 70 comprises four sections 160. Such sections 160 can be approximately equal in size and comprise approximately one-forth of the circumference (e.g., about 90 degrees) of the housing body 70.

Figure 8:
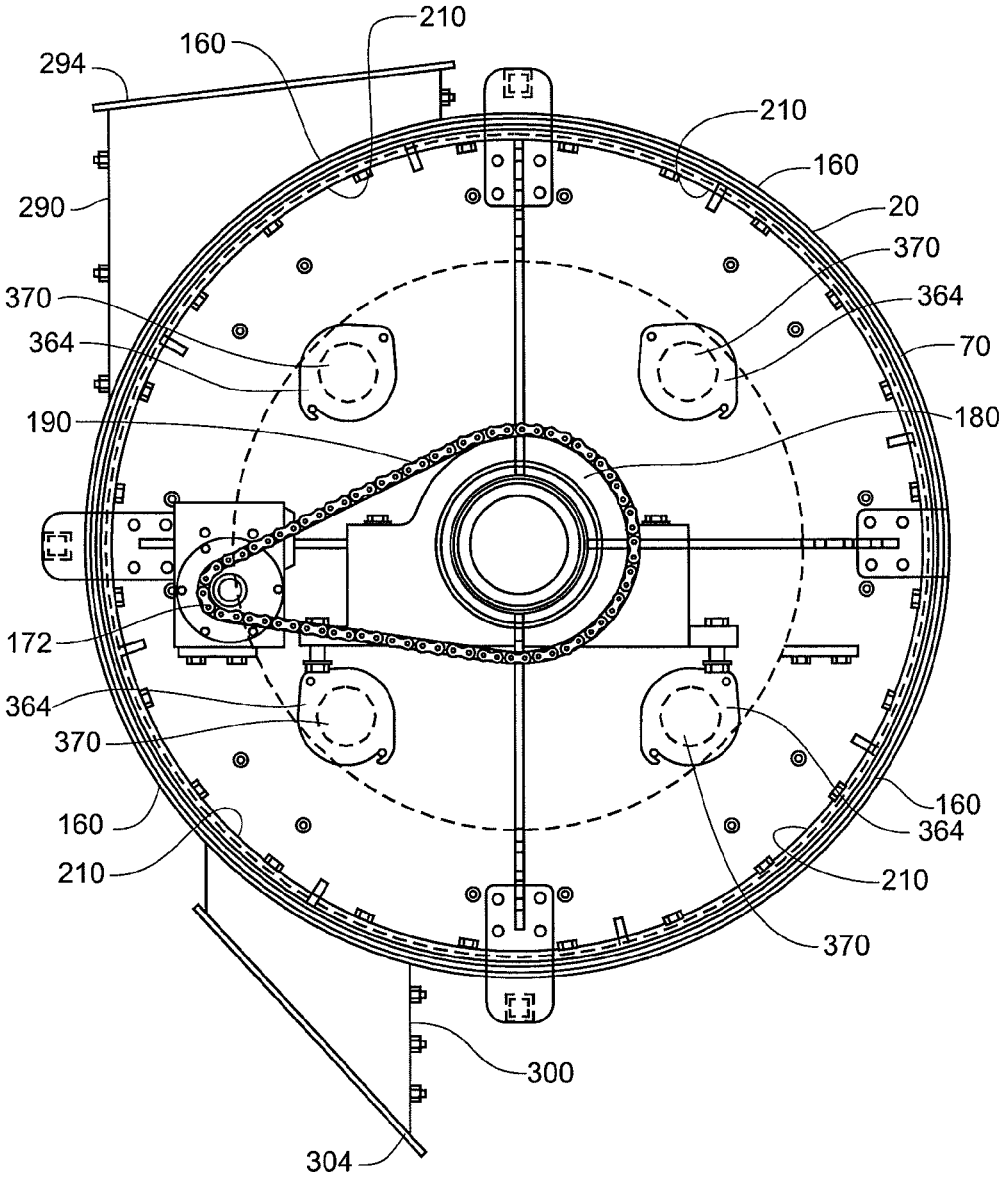
FIG. 8 shows a side plan view of a rotatable housing in accordance with an embodiment of the invention.

In some embodiments, the hammermill 10 includes a mechanism 170 useful for rotating the housing 20 about the axis of rotation. Such mechanisms are useful for facilitating the rotation of the housing 20, especially when one or more sections 160 of the housing 20 have been removed and the housing 20 is significantly out of balance. As shown best in FIG. 8, in some embodiments, the mechanism 170 includes a gear 172 and sprocket 180 assembly, connected by a chain 190. In some embodiments, the mechanism 170 includes a handle actuator 200. In such embodiments, an operator can rotate the handle actuator 200 to gain mechanical advantage (e.g., about 100:1) to rotate the housing 20 about its axis of rotation. Such a mechanism 170 generally has sufficient mechanical advantage to hold the housing 20 in position unless the actuator is actuated. Of course, the mechanism 170 can be driven by a power source. For example, an electric motor can be used to engage and rotate the actuator or engage and rotate the gear or sprocket directly.

As stated above, the hammermill 10 can include one or more cutting plates 30. The cutting plates, in combination with the hammers 50, are useful for reducing the size of the material. Accordingly, the hammermill 10 does not require perforated screens to control the finished particle size. Rather, in some embodiments, the particle size is determined and controlled by the hammers 50 and cutting plate 30 as the material moves through the hammermill 10.

Figure 7:
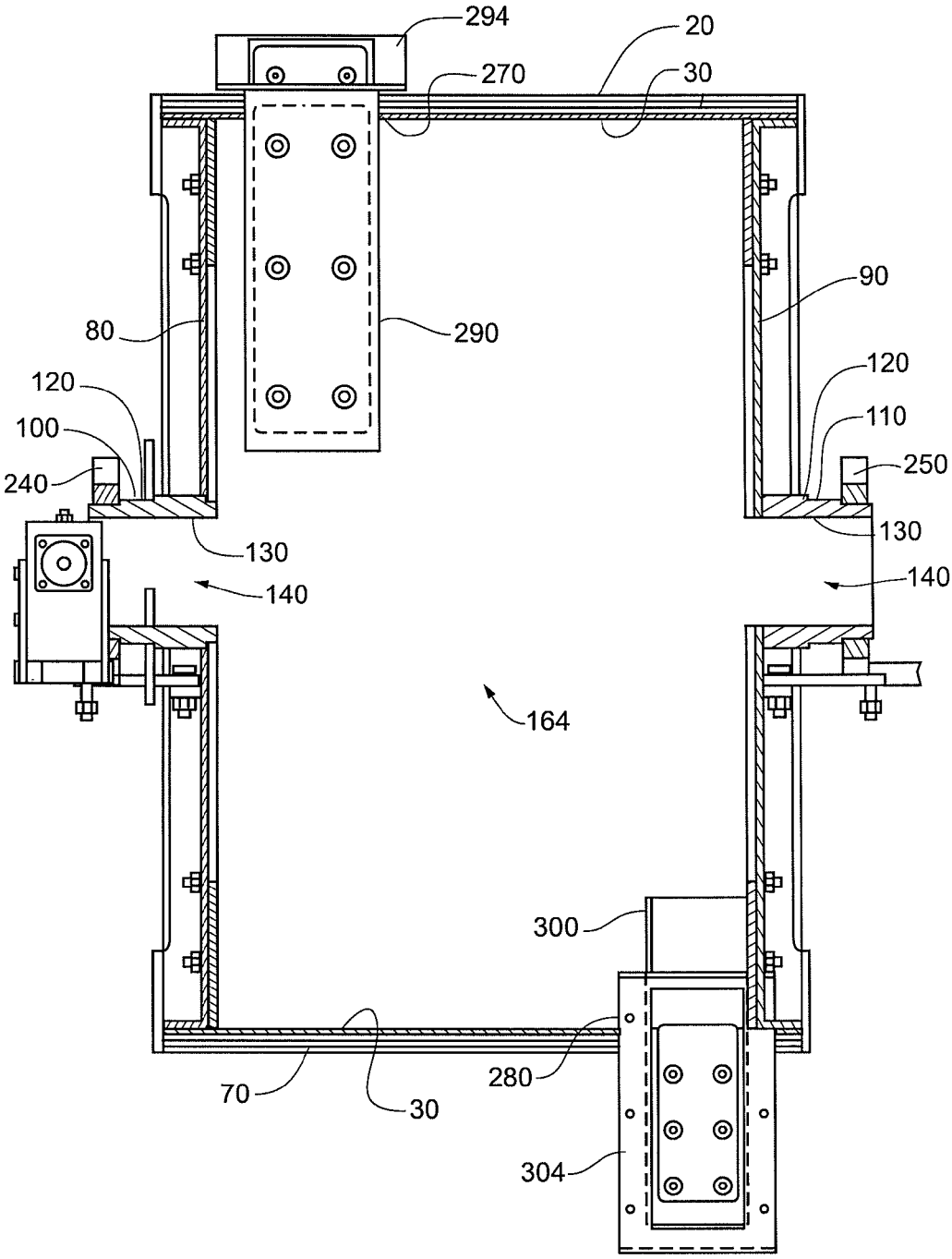
FIG. 7 shows a front cross-section view of a housing in accordance with an embodiment of the invention.
Figure 9:
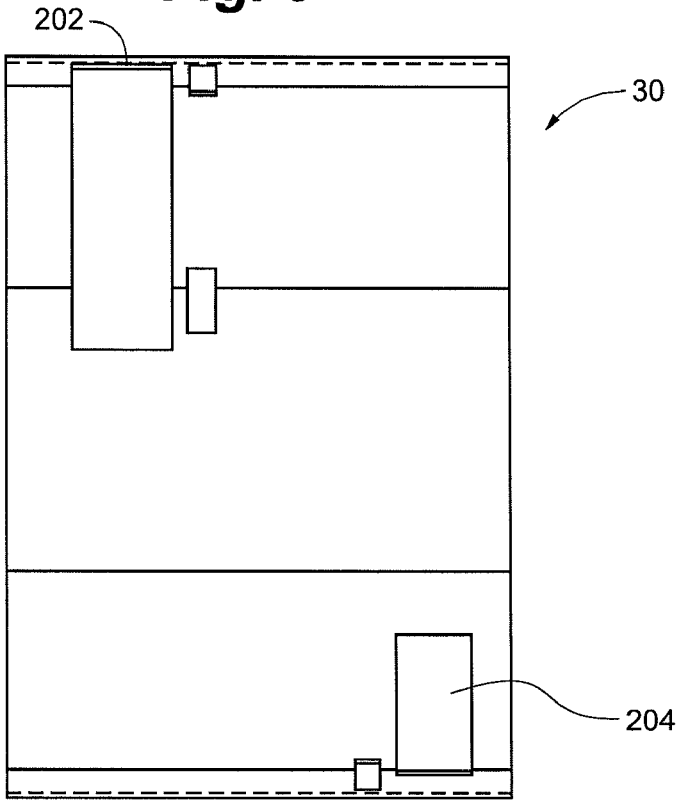
FIG. 9 shows a front plan view of a cutting plate in accordance with an embodiment of the invention.
Figure 10:
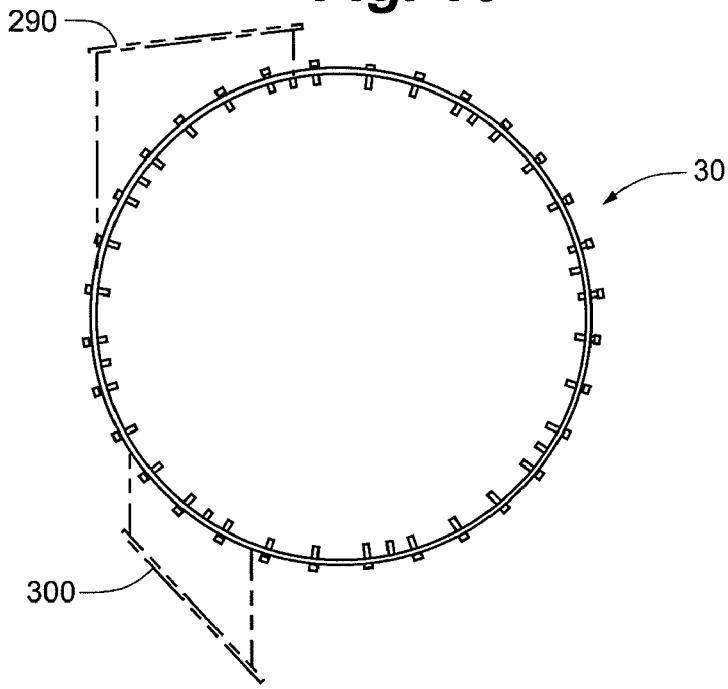
FIG. 10 shows a side plan view of a cutting plate in accordance with an embodiment of the invention.

In some embodiments, as shown best in FIGS. 2 and 7, the cutting plates 30 are in apposition to an inner surface 194 of the housing 20. In other embodiments, the inner surface 194 of the housing 20 itself can be considered the cutting plate 30. As shown in FIGS. 9 and 10, the cutting plate can include a generally cylindrical shape that allows it to be placed immediately within and/or in apposition to embodiments of the housing having a generally cylindrical shape. As shown in FIG. 9, an inlet aperture 202 and an outlet aperture 204 can be provided to allow for material to enter and exit the working chamber of the hammermill. These apertures can be aligned with an inlet spout 290 and outlet spout 300, respectively, as shown in phantom in FIG. 10 and described further below.

Further, in some embodiments, the cutting plates 30 include more than one cutting plate section 210. Such cutting plate sections 210 can coincide with sections 160 of the housing 20, or more than one cutting plate section 210 (e.g., 2) can be provided per section 160 of housing 20. Some embodiments of the housing body 70 are about 42 inches in diameter. In such embodiments, 8 cutting plates sections (each comprising about 45 degrees of the interior surface of the housing 20) can be provided, each weighing around 130 pounds. Accordingly, such sections are of a weight that can generally be handled by two operators.

The cutting plate 30 may include any feature useful for interacting with and reducing the size of the material. In some embodiments, the cutting plates include a first sheet comprising slots with a second sheet in apposition to the first sheet to prevent material from exiting through the slots. In other embodiments, the cutting plate 30 includes protrusions useful for interacting with the material. In some embodiments, the protrusions include welded beads. The slots or protrusions can be angled to direct the material across the working chamber and towards the outlet in a substantially helical pathway.

Figure 11:
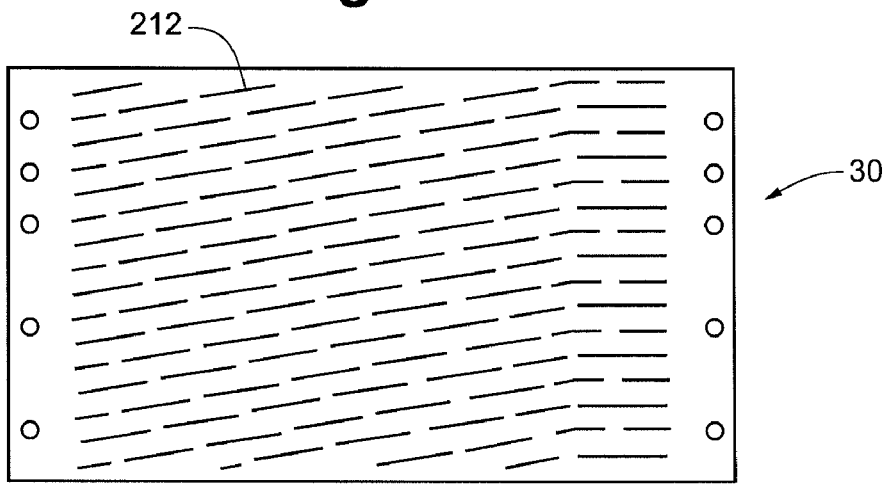
FIG. 11 shows a front plan view of an interior surface of a cutting plate in accordance with an embodiment of the invention.
Figure 12:
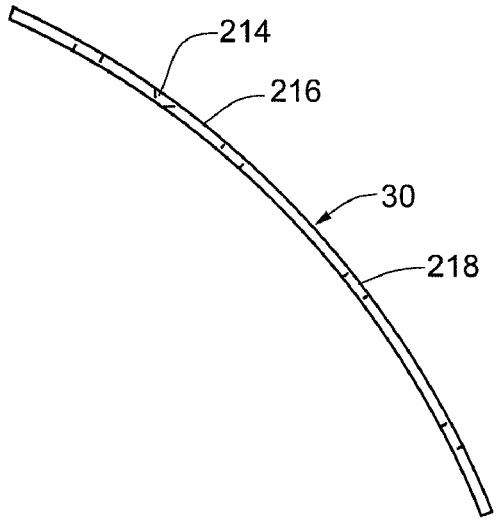
FIG. 12 shows a side plan view of a cutting plate in accordance with an embodiment of the invention.

FIGS. 11 and 12 show an embodiment of a cutting plate 30 that includes protrusions 212. With reference to FIG. 11, the angles of the protrusions 212 are set to direct material left to right when the hammers are rotating down to up. This configuration moves the material in a substantially helical pathway as it moves from the inlet to the outlet of the hammermill. As shown, the angle of the protrusions can change near the outlet side of the hammermill (the right side of FIG. 11), such as changing from being skewed relative to the axis of rotation to generally parallel with the axis of rotation. Such parallel protrusions are useful for avoiding unnecessarily directing material against an end plate and for directing material out the outlet of the hammermill.

As shown in FIG. 12, some embodiments of the cutting plate 30 are adapted to attach directly to the first and second end plates 80, 90. As shown, the cutting plate can have countersinking apertures 214 that allow it to be attached to the end plates with bolts without the head of the bolt extending outwardly of the outer surface of the cutting plate. The housing 20 can then be attached in apposition to the outer surface 216 of the cutting plate and attached to the end plates via apertures 218 defined by the cutting plate. In other embodiments, the cutting plates can be attached to the housing from the inside of the working chamber.

In some embodiments, the hammermill 10 includes a base 60 supporting a first pedestal 220 and a second pedestal 230. As shown best in FIGS. 2 and 7, the first and second pedestals can be placed proximate the first and second end plates of the housing 20. In certain embodiments, a first bushing block 240 rests on the first pedestal 220 and a second bushing block 250 rests on the second pedestal 230. The first and second bushing blocks are useful for rotationally supporting the housing 20. In some embodiments, the first end plate shaft 100 of the housing 20 is rotationally supported by the first bushing block 240 and the second end plate shaft 110 is rotationally supported by the second bushing block 250. Further, each end plate and corresponding end plate shaft can be provided in two or more end plate sections that can be disassembled from each other. Such an embodiment allows the housing 20 to be removed from the bushing blocks without removing the rotor assembly 40 from the base 60.

In certain embodiments, the first and second bushing blocks are split bushing blocks. In such embodiments each bushing block can be separated along a plane parallel to the axis of rotation. The upper portion of the bushing block can be removed from each side to allow the housing 20 to be removed from the base 60. In such embodiments, the lower portion of each bushing block can remain coupled to the pedestals. In some embodiments, the bushing blocks are keyway aligned on the pedestals. Such keyways promote the proper alignment of the bushing blocks, and hence the proper alignment of the axis of rotation of the housing 20 when the end plate shafts are received within the bushing blocks.

In some embodiments, as shown in FIG. 2, a fixation mechanism 260 is provided to selectively rotationally fix the housing 20 relative to the base 60. The fixation mechanism 260 can include one or more attachment arms coupled, such as by bolts, to one of the pedestals and housing end plates. When rotation of the housing 20 is desired, the attachment arm can be removed to allow the housing 20 to rotate relative to the base 60 (and the pedestals and bushing blocks rigidly fixed thereto). During operation, or when it is otherwise desirable to fix the rotation of the housing 20 relative to the base 60, the attachment arms can be engaged with the housing 20. In some embodiments, the end plates have flanges to receive the attachment arm at several positions so that that the rotational position of the housing 20 can be fixed relative to the base 60 at several desired rotational positions.

As shown in FIGS. 2-8, in some embodiments, the housing 20 (e.g., housing body 70) defines an inlet 270 for receiving material and an outlet 280 for discharging material. In certain embodiments, the hammermill 10 causes material to move in a generally helical pathway between the inlet and the outlet. The inlet and the outlet can be included at any circumferential location along the body 70 of the housing 20. In some embodiments, the inlet is located proximate the top of the body 70 such that material to be comminuted tends to fall into the body 70. In some embodiments, such as the embodiment shown in FIGS. 3 and 4, the outlet is located proximate the bottom of the body 70 such that the comminuted material tends to fall out of it. In other embodiments, such as the embodiment shown in FIGS. 5 and 6, the outlet is located proximate the three o'clock position as viewed from an end of the hammermill 10. Further, the inlet and outlet can be located at any axial location along the housing body 70. As shown in FIGS. 2 and 7, the inlet and outlet can be offset from each other relative to the axis of rotation. Such embodiments are useful for allowing the material to advance along a generally helical path through the body 70 of the hammermill 10 from the inlet to the outlet.

In some embodiments, the hammermill 10 includes an inlet spout 290 in communication with the inlet, the inlet spout 290 having an inlet spout connection 294 being slanted to allow for rotation of the housing 20. Further, in some embodiments, the hammermill 10 includes an outlet spout 300 in communication with the outlet, the outlet spout 300 having an outlet spout connection 304 being slanted to allow for rotation of the housing 20. In some embodiments, the housing 20 is rotatable about the axis of rotation in a first direction (e.g., counterclockwise) for about 90 degrees and a second direction (e.g., clockwise) for about 210 degrees, for a total of about 300 degrees of rotation. Of course the spouts may be removed to provide for additional rotation in either direction.

Figure 13:
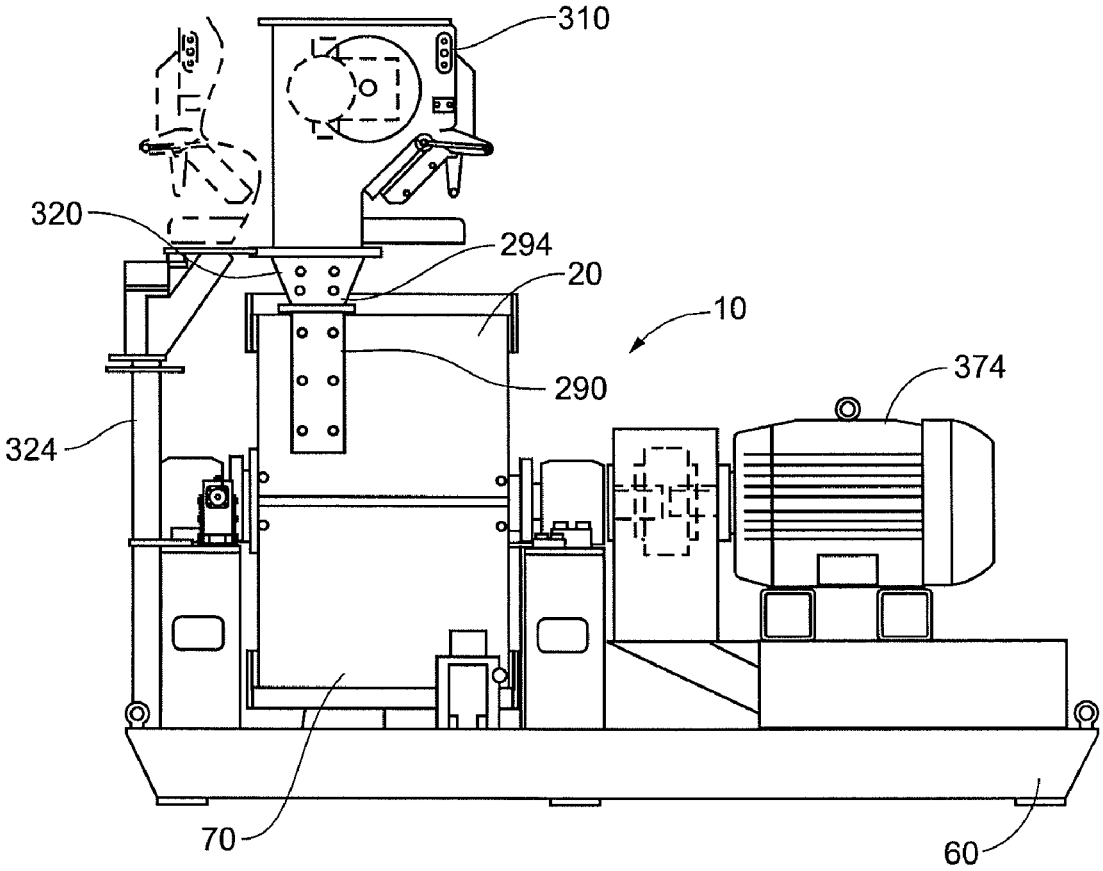
FIG. 13 shows a front plan view of a hammermill and a feeder in a first position in accordance with an embodiment of the invention.
Figure 14:
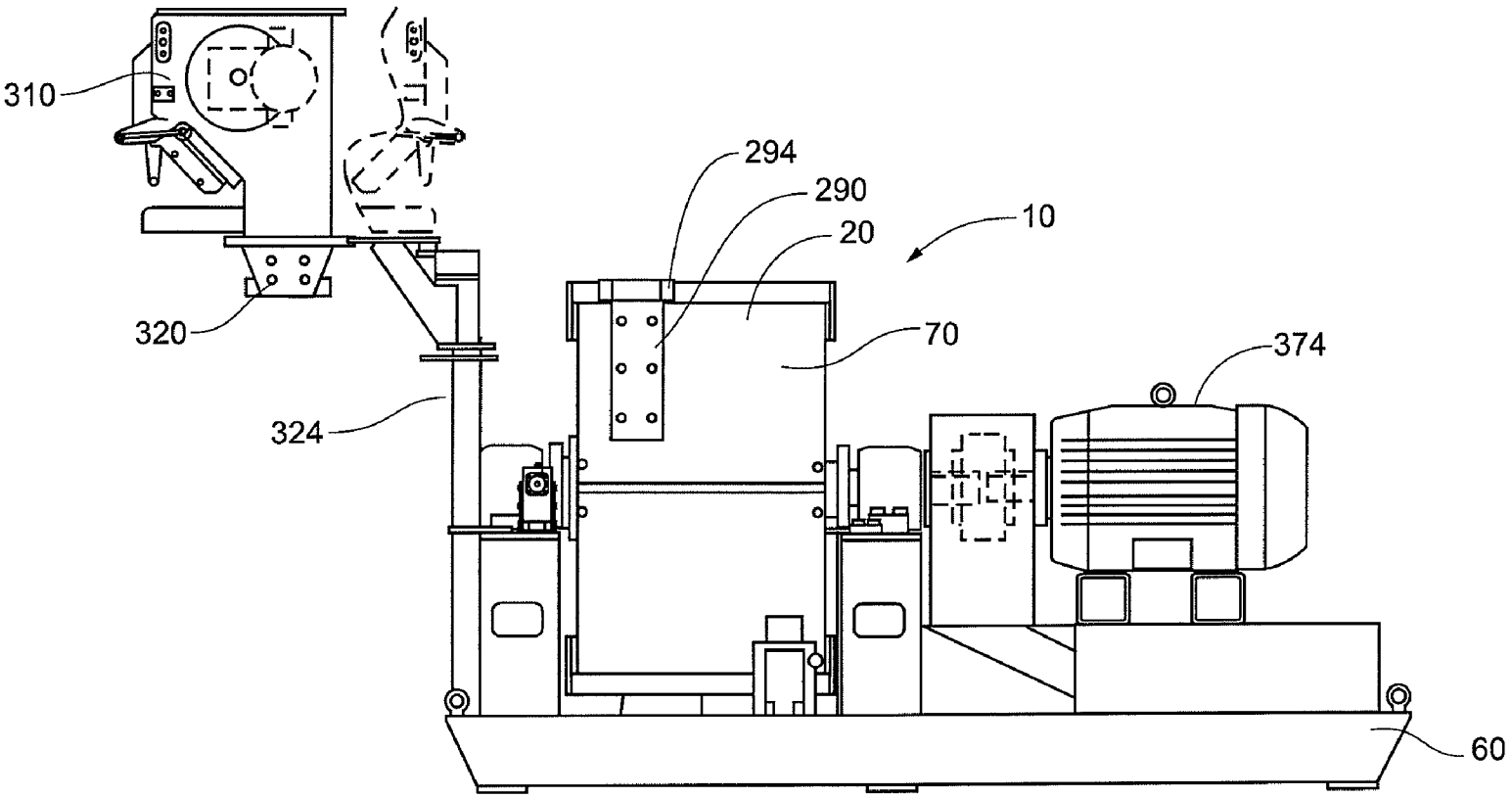
FIG. 14 shows a front plan view of the hammermill and feeder of FIG. 13 in a second position in accordance with an embodiment of the invention.

As shown best in FIGS. 13-14, some embodiments include a feeder 310 for facilitating the introduction of material into the hammermill 10. As shown, the feeder 310 can have a feeder connection 320 adapted to mate with the inlet spout connection 294. Such a feeder 310 and inlet spout connection 294 allows the body 70 of the housing 20 to selectively engage with the feeder 310 as it is rotated. Further, in some embodiments, the feeder 310 is rotatably mounted on a feeder pedestal 324. Such rotatable mounting allows for the feeder 310 to be easily positioned away from the housing 20 to provide overhead access to facilitate removal of the housing 20 and/or rotor assembly 40 from the base 60. As shown in FIGS. 13 and 14, the feeder 310 in some embodiments is rotatable about a feeder axis generally normal to the axis of rotation of the housing 20 body 70. FIG. 13 shows the feeder 310 in a first position engaged with the inlet spout 290, and FIG. 14 shows the feeder 310 in a second position disengaged from the inlet spout 290. Such an embodiment allows for even greater access to the interior of the hammermill 10.

As shown in FIG. 2, the rotor assembly 40 can include any apparatus useful for supporting and rotating the hammers 50. In some embodiments, the rotor assembly 40 includes a stub shaft assembly. In such embodiments, the rotor shaft 150 includes a first stub rotor shaft 324 with a first plate flange 330 and a second stub rotor shaft 332 with a second plate flange 334. A first head disk 338 can be coupled to the first plate flange 330 and a second head disk 342 can be coupled to the second plate flange 334. At least one intermediate disk 346 can be included between the first and second head disks, and at least one spacer ring 350 can be included between the first and second head disk 342. At least one tension rod 354 can be included to hold the rotor assembly 40 together. As shown, the head and intermediate disks may support several, such as four, hammer pins 360. Each hammer pin can pivotably support a plurality of hammers 50. In some embodiments, as shown best in FIG. 8, at least one of the first and second end plates includes at least one access aperture 364 positioned to allow for the removal of a hammer pin. The access apertures can have pivotable covers 370 to cover the access apertures when desired. The rotor assembly 40 is generally driven by a motor 374.

In some embodiments, the base 60 includes a first bearing housing 380 supported by the first pedestal 220 and a second bearing housing 390 supported by the second pedestal 230, wherein a first end of a rotor shaft 150 (e.g., first stub rotor shaft 324) of the rotor assembly 40 is rotationally supported by the first bearing housing 380 and a second end of a rotor shaft 150 (e.g., second stub rotor shaft 332) of the rotor assembly 40 is rotationally supported by the second bearing housing 390. The first and second bearing housings can be split so that the top portion of each can be removed to allow the rotor assembly 40 to be removed from the base 60. In some embodiments, the first end of the rotor shaft 150 is coaxially aligned with the first end plate shaft 100 and the second end of the rotor shaft 150 is coaxially aligned with the second end plate shaft 110.

Embodiments of the invention include methods of making and using any of the hammermills described above. In some embodiments, an operator can rotate the housing 20 by disengaging the engagement mechanism. The housing 20 can then be rotated about its rotational axis. In embodiments having a mechanism useful for assisting in the rotation of the housing 20, the operator can actuate the mechanism to rotate the housing 20. In some embodiments, the operator can remove a section of the housing body 70 from the end plates. Next, the housing 20 can be rotated so as to position another section of the body so it can be easily removed. For example, a section can be removed and the body 70 can be rotated approximately a quarter turn such that the next body section is in a generally upward position. A maintenance step, such as replacing a worn cutting plate 30, can then be performed. Cutting plates attached to the housing body 70 sections can be separated therefrom and replacement cutting plates can be attached.

The sections can be removed and the housing 20 rotated until the interior of the housing 20 is sufficiently exposed for a maintenance step. For example, when replacing the hammers 50, the pivotable covers 370 of the end plates can be pivoted open to expose the access apertures 364. The hammer pins 360 can then be retracted through the apertures as the hammers 50 are removed from the pins. Replacement hammers 50 can be placed on the hammer pin as it is repositioned in the rotor assembly 40.

In some embodiments, the housing 20 and/or rotor assembly 40 can be removed from the base 60 and placed on another base in a different location, such as in a processing line. To remove the housing, the first and second bushing blocks can be disassembled, and any engagement mechanism disengaged, and the end plates can be disassembled into two or more sections. The housing 20 can then be lifted (e.g., by lifting lug 96) from the base 60 and its supporting pedestals. The housing 20 can then be placed on the disassembled bushing blocks of the other base. To remove the rotor assembly, the bearing blocks are disassembled and the rotor assembly disengaged from the motor. Of course, the housing and rotor assembly can be simultaneously removed from the base.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

What is claimed is:

1. A hammermill for comminuting material comprising:

a housing, wherein the housing includes a generally cylindrical body, a first end plate, and a second end plate, wherein the first end plate includes a first end plate shaft and the second end plate includes a second end plate shaft, wherein the first and second end plate shafts each have an outer cylindrical surface and an inner cylindrical surface;

a base with a first pedestal and a second pedestal to support the housing;

a cutting plate disposed within the housing;

a rotor assembly rotatably mounted within the housing about an axis of rotation, the inner cylindrical surface of the housing defining a cavity to receive a rotor shaft of the rotor assembly; and a plurality of hammers functionally coupled to the rotor assembly, the housing being rotatable about the axis of rotation, further including a fixation mechanism to selectively rotationally fix the housing relative to the base.

2. The hammermill of claim 1, wherein the generally cylindrical body comprises two or more sections.

3. The hammermill of claim 1, wherein the generally cylindrical body comprises four sections.

4. The hammermill of claim 1, wherein at least one of the first and second end plates includes at least one access aperture positioned to allow removal of a hammer pin.

5. The hammermill of claim 1, further including a mechanism for rotating the rotatable housing about the axis of rotation.

6. The hammermill of claim 5, wherein the mechanism includes a gear and sprocket assembly.

7. The hammermill of claim 6, wherein the mechanism includes a handle actuator.

8. The hammermill of claim 1, wherein the cutting plate is generally cylindrical and in apposition to an inner surface of the rotatable housing.

9. The hammermill of claim 8, wherein the rotatable housing includes two or more housing sections and the generally cylindrical cutting plate includes two or more cutting plate sections per housing section.

10. The hammermill of claim 1, wherein the cutting plate includes a plurality of protrusions.

11. The hammermill of claim 10, wherein the protrusions include welded beads.

12. The hammermill of claim 1, further including a first bushing block supported by the first pedestal and a second bushing block supported by the second pedestal.

13. The hammermill of claim 12, wherein the first end plate shaft is rotationally supported by the first bushing block and the second end plate shaft is rotationally supported by the second bushing block.

14. The hammermill of claim 1, further including a first bearing housing supported by the first pedestal and a second bearing housing supported by the second pedestal, wherein a first end of the rotor shaft of the rotor assembly is rotationally supported by the first bearing housing and a second end of the rotor shaft of the rotor assembly is rotationally supported by the second bearing housing.

15. The hammermill of claim 14, wherein the first end of the rotor shaft is coaxially aligned with the first end plate shaft and the second end of the rotor shaft is coaxially aligned with the second end plate shaft.

16. The hammermill of claim 1, wherein the housing body defines an inlet and an outlet.

17. The hammermill of claim 16, wherein the hammermill includes an inlet spout in communication with the inlet, the inlet spout having an inlet spout connection being slanted to allow for rotation of the housing.

18. The hammermill of claim 17, wherein the hammermill includes an outlet spout in communication with the outlet, the outlet spout having an outlet spout connection being slanted to allow for rotation of the housing.

19. The hammermill of claim 17, further including a feeder having a feeder connection adapted to mate with the inlet spout connection.

20. The hammermill of claim 19, wherein the feeder is rotatably mounted on a feeder pedestal.

21. The hammermill of claim 19, wherein the feeder is rotatable about a feeder axis generally normal to the axis of rotation of the housing body.

22. The hammermill of claim 16, wherein the hammermill includes an inlet spout in communication with the inlet, the inlet spout having an inlet spout connection being slanted to allow for rotation of the housing, and an outlet spout in communication with the outlet, the outlet spout having an outlet spout connection being slanted to allow for rotation of the housing, the housing being rotatable about the axis of rotation about 300 degrees.

23. The hammermill of claim 16, wherein the inlet and outlet are offset from each other relative to the axis of rotation.

24. The hammermill of claim 1, wherein the rotor assembly includes a first stub rotor shaft with a first plate flange, a second stub rotor shaft with a second plate flange, a first head disk coupled to the first plate flange and a second head disk coupled to the second plate flange, at least one intermediate disk between the first and second head disks, a spacer ring between the first and second head disk, and at least one tension rod.

25. The hammermill of claim 1, wherein the housing defines an inlet for receiving material and an outlet for discharging material, the hammermill causing material to move in a generally helical pathway between the inlet and the outlet.

* * * * *